United States Patent [19]

Sluis et al.

[11] 4,196,412

[45] Apr. 1, 1980

[54] DRIVER ALERT SYSTEM

[75] Inventors: Mark H. Sluis, Pittsford; John H. Auer, Jr., Fairport; Carl G. Shook, Pittsford; Robert F. Anderson; David B. Rutherford, both of Rochester, all of N.Y.

[73] Assignee: General Signal Corporation, Stamford, Conn.

[21] Appl. No.: 869,740

[22] Filed: Jan. 16, 1978

[51] Int. Cl.[2] ..... G08G 1/02; G08B 23/00

[52] U.S. Cl. ..... 340/32; 340/31 R; 340/38 R; 340/575; 340/576

[58] Field of Search ..... 340/32, 31 R, 38 R, 340/38 L, 539, 576, 575, 573; 180/82 R, 99

[56] References Cited

U.S. PATENT DOCUMENTS

| | | | |
|---|---|---|---|
| 1,803,292 | 4/1931 | Adler | 340/32 |
| 2,025,106 | 12/1935 | Hirshfeld | 340/32 |
| 3,044,043 | 7/1962 | Wendt | 340/32 |
| 3,185,992 | 5/1965 | Smith | 340/32 |
| 3,416,129 | 12/1968 | Dean | 340/32 |
| 3,532,986 | 10/1970 | Gelushia et al. | 340/32 |
| 3,775,743 | 11/1973 | Carter | 340/32 |
| 3,978,447 | 8/1976 | Bankes | 340/33 |

*Primary Examiner*—John W. Caldwell, Sr.
*Assistant Examiner*—Donnie L. Crosland
*Attorney, Agent, or Firm*—Milton E. Kleinman; Stanley B. Green

[57] ABSTRACT

Apparatus for insuring a vehicle operator's attentiveness at potentially dangerous locations along a path of travel. A signalling device is provided in advance of a potentially dangerous location, in the direction of travel of the vehicle. A vehicle carried signal responsive device responds to the signalling device when within the effective zone of the signalling device. The vehicle includes warning apparatus, for example, an alarm and a buzzer. The vehicle also includes an operator actuatable push button and a speed sensing apparatus. A control device responds to the push button and to the vehicle carried signal responsive device to operate either the buzzer or the alarm. If the operator evidences his alertness to the potentially dangerous location by actuating the push button prior to reaching the signalling device (within some constraint), the control apparatus merely sounds the buzzer when the signalling device is detected and resets itself. On the other hand, if the operator fails to actuate the push button in advance of detection of the signalling device, or, if his actuation is too far in advance of detection, then the alarm is energized and will remain energized until the vehicle is brought to a stop, or a low speed, at which point, push button actuation can cancel the alarm.

23 Claims, 11 Drawing Figures

FIG 1
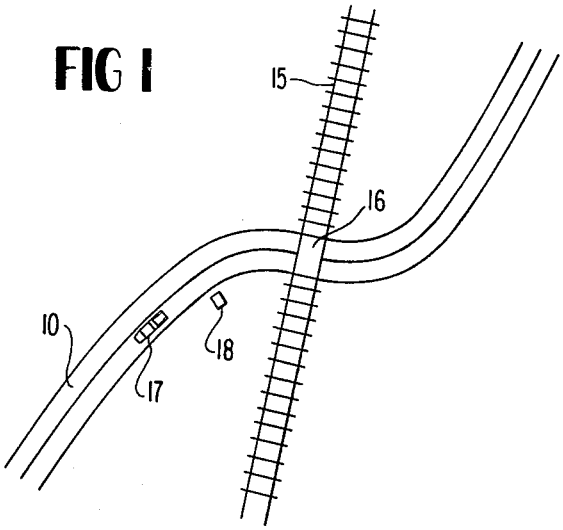
FIG 2 VEHICLE CARRIED APPARATUS
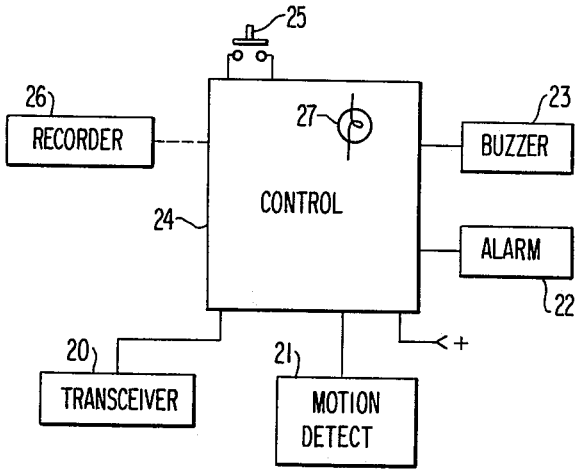
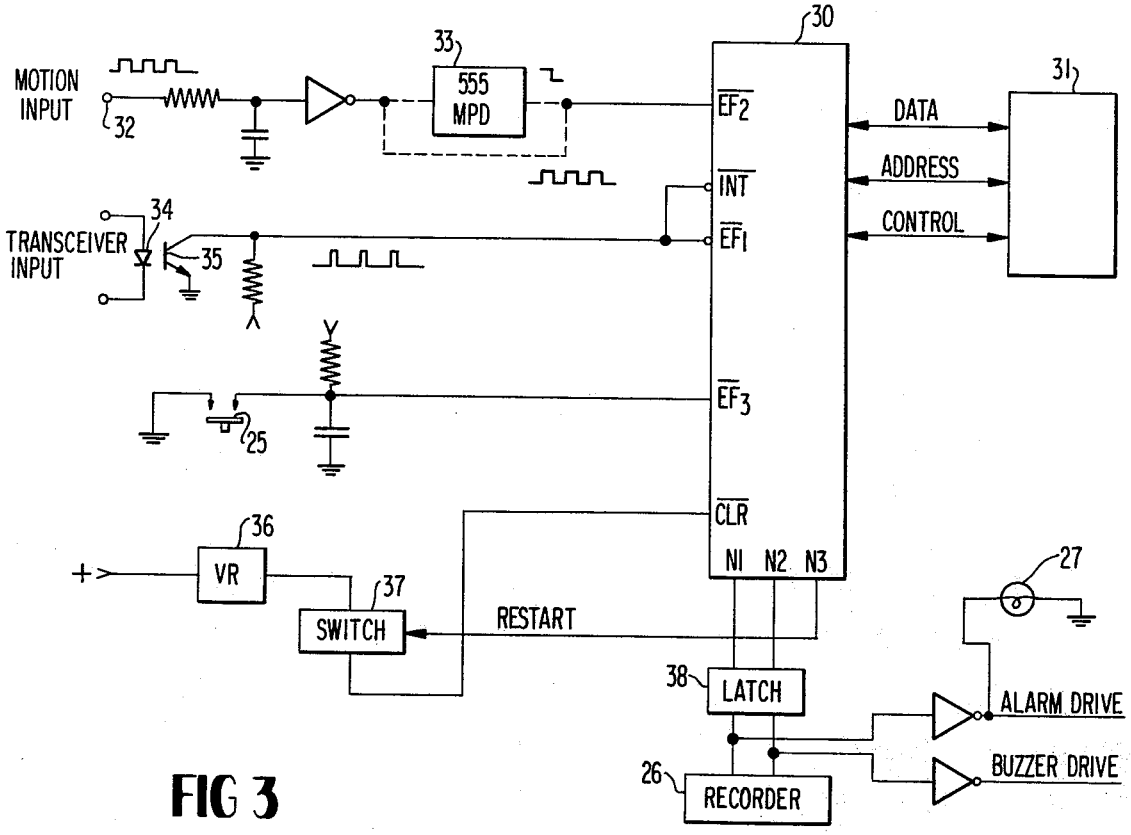
FIG 3

FIG 5D
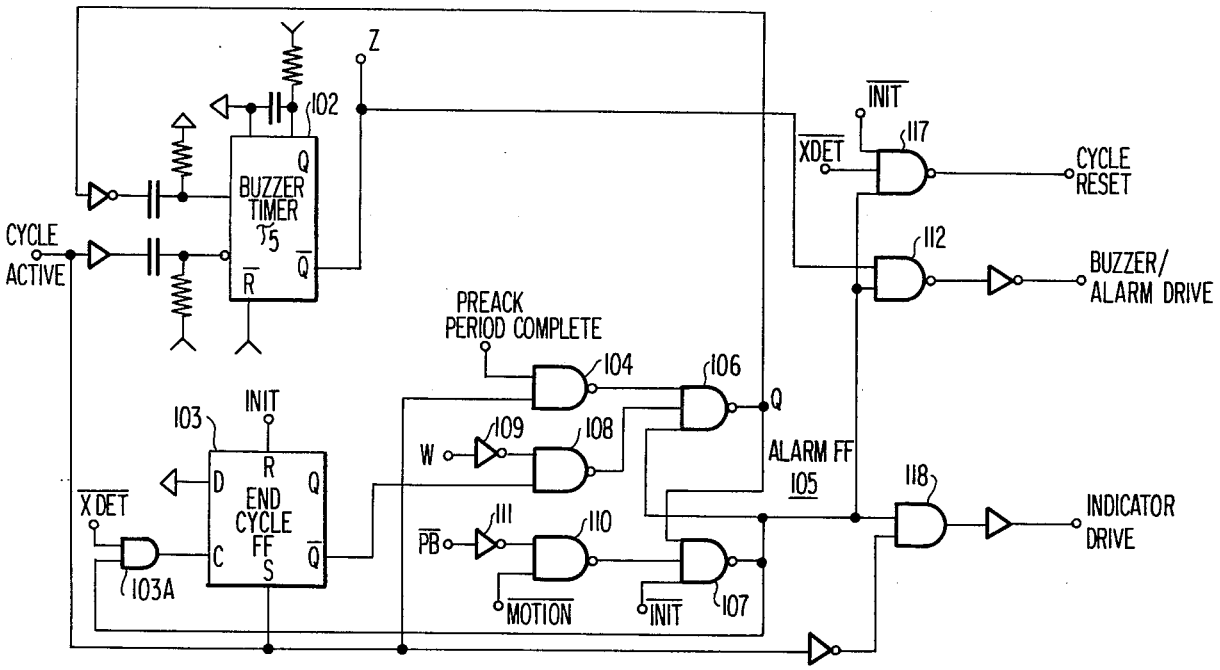
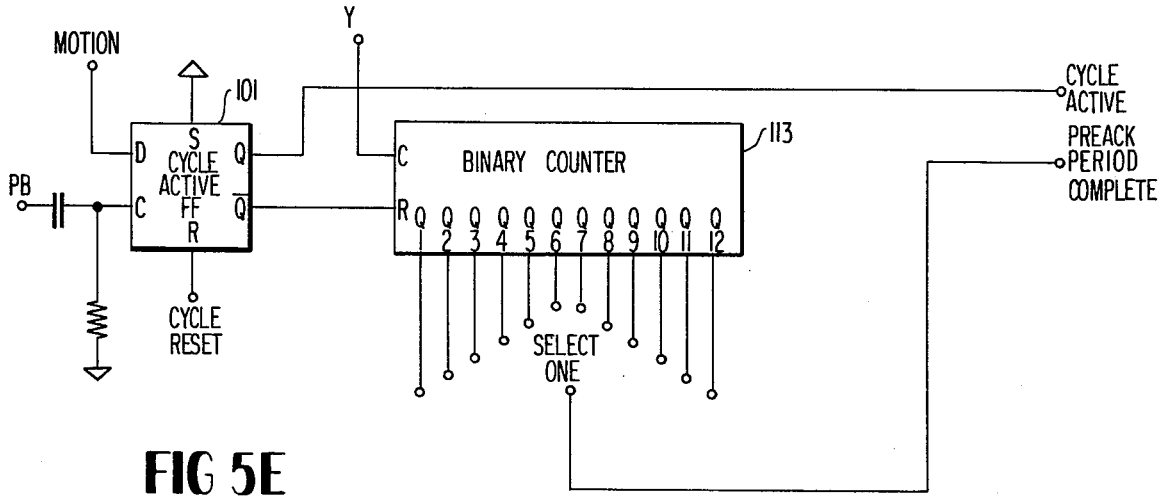
FIG 5E

DRIVER ALERT SYSTEM

FIELD OF THE INVENTION

The invention relates to safety equipment for vehicles.

BACKGROUND OF THE INVENTION

Those skilled in the art of making safer the roads travelled by the public have been aware for many years that there are potentially dangerous locations which can readily be identified in advance. While those locations can readily be identified, those skilled in the art have not been able to achieve a combination of apparatus which will assure operator attentiveness at these potentially dangerous locations without also increasing the potential for injury.

One well-known potentially dangerous location is a highway-railroad crossing at a common grade, i.e., a grade crossing. In efforts to protect the highway user at a grade crossing, arrangements have been proposed, such as that illustrated in U.S. Pat. No. 3,978,447, for signalling to a vehicle that a train is approaching. While this is a laudable goal, it does have the potential, when not properly used of "teaching" the user that if no signal is provided, then no train is approaching. This is potentially disastrous. Once the user has learned (albeit, erroneously) that the absence of a signal means the absence of a train, he will tend to be less cautious in the absence of a signal and, the failure of the warning device can obviously lead to injury.

In another typical arrangement, such as that proposed in U.S. Pat. No. 2,025,106, with regard to another highway railroad grade crossing, the detection of an approaching train first provides a signal to the highway user, and if he persists in approaching the crossing, the vehicle in which he is travelling is disabled, i.e., the ignition is open circuited. This arrangement is even more dangerous than an unguarded crossing because failure can leave a disabled vehicle in the path of an approaching train.

Other proposed arrangements are not as dangerous in that they merely provide a signal for the vehicle operator that he is approaching a potentially dangerous location, see, for example, U.S. Pat. Nos. 1,803,292 and 3,775,743. Presumably, the operator, alerted by the signal, will exercise greater caution in the vicinity of the potentially dangerous location.

A similar arrangement is shown in U.S. Pat. No. 3,416,129, where, in addition to providing the operator with a signal, which may be annoying, the system requires the operator to bring the vehicle to a full stop to inhibit the annoying alarm.

The defect in all of the foregoing systems is the failure to provide any mechanism for overcoming a failure in the signalling system. Since the arrangements disclosed in U.S. Pat. Nos. 3,416,129; 3,775,743 and 1,803,292 do not respond to the presence of a train, they do not exhibit the potential for misuse in that lack of a signal cannot be taken as a positive safety indication. Nevertheless, if the signalling system does not operate, then the alerting function is not performed.

It is therefore one object of the present invention to provide a driver alert system which is operative to alert a vehicle operator to his approach to a potentially dangerous location, and which furthermore provides at least some mechanism for alerting an operator even in the presence of the failure of the system. It is another object of the present invention to provide the foregoing arrangement in which the system is operative to energize an annoying alarm on board a vehicle at the vehicle's approach to a potentially dangerous location, but which also provides that the annoying alarm can be inhibited by operator pre-acknowledgement. It is a further object of the present invention to provide a pre-acknowledgement system such as that briefly referred to which is also effective to detect failures in the system.

SUMMARY OF THE INVENTION

The present invention meets these and other objects of the invention by providing a driver alert arrangement which includes a signalling means located on the wayside in advance of the potentially dangerous location in the direction of travel of the vehicle, a first means on the vehicle responsive to the signalling means for providing a distinctive signal on detection of the signalling means, alarm means on board the vehicle having at least two different modes of operation, a first mode which provides a relatively annoying signal and a second mode, which may be of a brief duration, an operator actuated push button on the vehicle, speed sensing means for sensing whether or not the vehicle is exceeding some predetermined low speed, and control means. The control means responds to the first means, the operator actuated push button and the vehicle speed sensing means to energize the alarm means if the operator has not actuated the push button within a predetermined constraint preceding the first means' detection. On the other hand, if the push button is actuated within the predetermined constraint prior to detection of the signalling means, the control means energizes the alarm means in a second mode for a predetermined time to inform the operator that the system has operated correctly. If the alarm is energized because of the operator's failure to actuate the push button within a predetermined constraint, prior to detection of the signalling means, the alarm remains energized until the vehicle speed sensing means indicates the vehicle has been brought to a speed less than some low speed at which time operation of the push button will serve to cancel the alarm. Pre-acknowledgement for longer than the constraint also results in alarm energization which requires a speed reduction, below the low speed threshold before it can be cancelled. This prevents continuous actuation of the push button. The predetermined constraint can be a function of time or distance travelled.

Inasmuch as the system is not responsive to a specific danger condition such as the presence of a train approaching a grade crossing, the failure of the system does not lead to the disastrous consequences which can ensue in a system which signals the approaching train. At the same time, the system does not interfere with normal operation of the vehicle, thus preventing the anomolous condition of a safety system disabling a vehicle in a dangerous location. The system "teaches" the operator that his pre-acknowledgement will prevent actuation of the annoying alarm. A further advantage is that, if the operator properly operates the push button prior to detection of the signalling means, and the signalling means is not detected within the predetermined constraint, then the alarm is energized. The operator is thus informed of a potential failure in the signalling means which can be reported. In this fashion, the system is self-revealing of failures in the signalling means.

BRIEF DESCRIPTION OF THE DRAWINGS

The invention will now be more particularly described so as to enable those skilled in the art to practice the invention in the following specification when taken in conjunction with the attached drawings in which like reference numerals identify identical apparatus and in which:

FIG. 1 is a plan view of a typical utility for the inventive apparatus;

FIG. 2 is a block diagram of the vehicle carried apparatus;

FIG. 3 is a detailed block diagram of a microprocessor based embodiment of the invention;

FIGS. 5A–E illustrate a discrete circuit arrangement of the invention; and

DETAILED DESCRIPTION OF PREFERRED EMBODIMENTS

Figure 4:
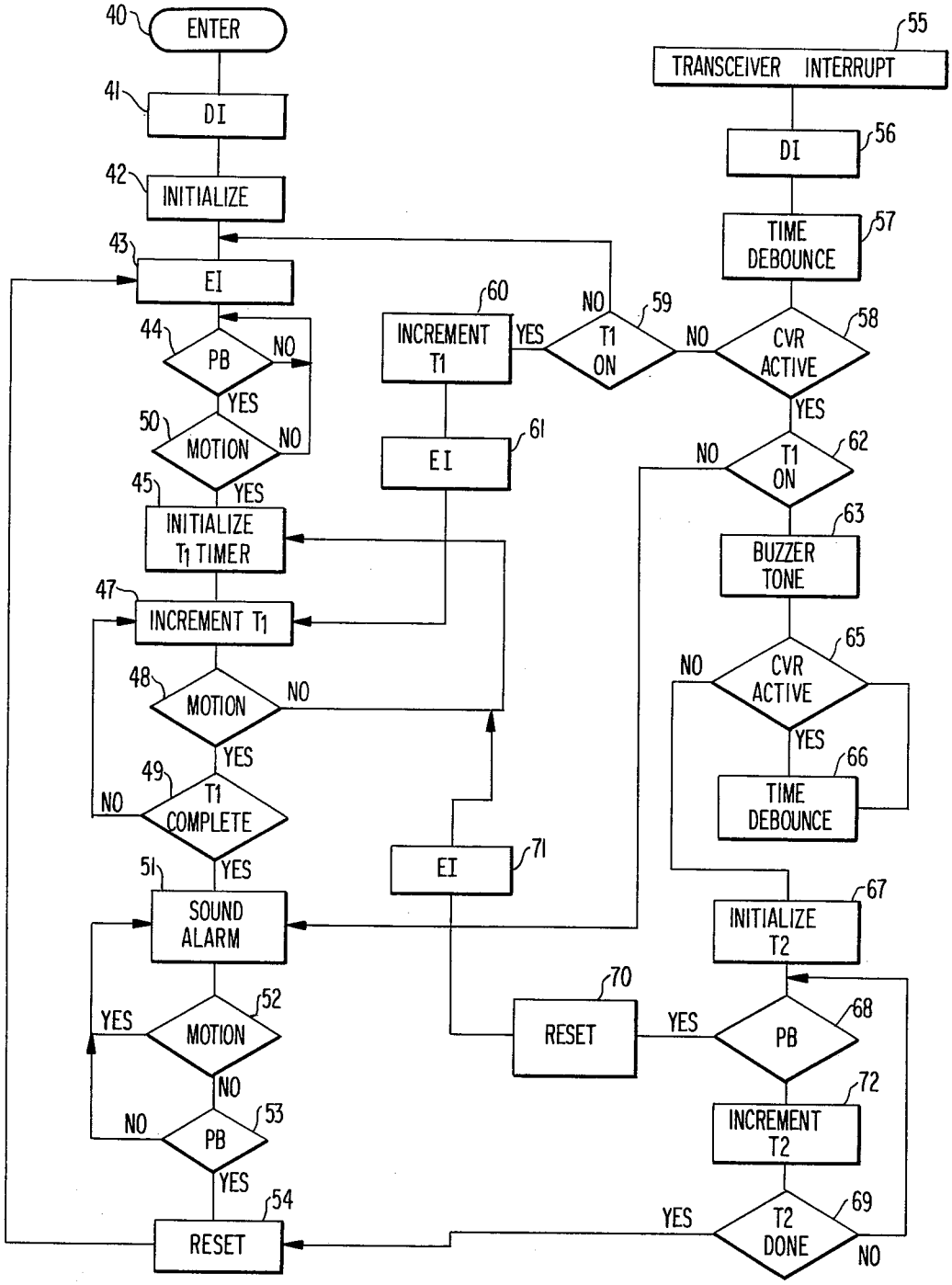
FIG. 4 is a flow diagram for the program employed with the microprocessor embodiment of FIG. 3.

As mentioned above, the apparatus of the present invention operates on a basis which is decidedly different from the operating principles employed in the prior art. The present invention proceeds on the basis that there is no substitute for responsible action by the motor vehicle operator. The most sophisticated system cannot take the place of an alert, sensible and safe operator. A system which provides an alarm only when a dangerous condition is encountered, such as when a train is approaching a grade crossing, can develop a tendency in the motor vehicle operators to interpret the lack of an alarm as a positive indication that there is no approaching train. Since it is not practicable to make a fail-safe warning system of the foregoing type, any system which proceeds on that basis provides an unacceptable risk. The present invention operates on the basis of alerting an operator to his approach to a potentially dangerous location, for example, a railroad grade crossing. This is accomplished by requiring him to acknowledge a warning sign, thus reminding him that he is approaching such a potentially dangerous location and that he must determine if the potentially dangerous location presents an actually dangerous situation. Should the operator fail to acknowledge, an alarm sounds continuously until the vehicle is brought to substantially a full stop. On the other hand, if the operator correctly acknowledges but the signalling means is not detected, the alarm is also energized and the operator's attention is directed to the potential failure of the signalling means.

The inventive apparatus exhibits another advantage in that the wayside mounted apparatus can be totally independent of power, i.e., it can be a wholly passive device.

Two embodiments of the invention will now be described in detail in which the potentially dangerous location is a railroad grade crossing. Those skilled in the art will appreciate that the invention is not limited to use at railroad grade crossings, but can be employed at any potentially dangerous location at which the motor vehicle operator should be particularly alert.

As shown in FIG. 1, a railroad track 15 crosses a roadway 10 at a common grade; the exemplary grade crossing 16. As shown in FIG. 1, a motor vehicle 17 is approaching the grade crossing. Located on the wayside in advance of the potentially dangerous location in the direction of travel of the vehicle 17, is a signalling means 18. Vehicle 17 carries a transceiver 20 (not illustrated in FIG. 1) which cooperates with the signalling means 18 and issues a distinctive signal when the signalling means 18 is detected. The transceiver 20 and signalling means 18 can take a variety of forms, the only requirement is that the transceiver 20 is capable of detecting the signalling means 18 but that the zone of detection be limited so that, preferably, vehicles travelling in the opposite direction on the roadway 10 do not detect the signalling means 18. Preferably, the signalling means 18 is associated with a visually perceivable object such as a signpost so that the operator can readily identify the location of the signalling means 18. Also, preferably, the signalling means 18 is a passive device which therefore does not require a power supply. For example, the transceiver 20 can be arranged to emit short bursts of electromagnetic energy which are received by the signalling means 18 and operated on thereby in a distinctive fashion, i.e., by modifying the frequency. When the transceiver 20 receives an "echo" in which the energy has been operated on so as to be detectable, transceiver 20 indicates that it has detected the signalling means 18. In accordance with the foregoing requirements, the transmissions from the transceiver 20 can be of extremely low power and thus would be effective only for very short distances, i.e., about 30 feet. Therefore, when the vehicle is within this range of the signalling means 18, an echo will be received. If the driver has pre-acknowledged, i.e. distinctively operated the apparatus to indicate his alertness to his approach to the potentially dangerous location, prior to reception of the echo, energization of an alarm is inhibited. On the other hand, if the operator fails to pre-acknowledge then detection of the signalling means operates to energize an alarm. While the operator has the ability to disable the alarm, once it is energized, he can only disable the alarm after stopping or substantially stopping the vehicle.

FIG. 2 illustrates, in schematic form, the vehicle carried apparatus. As shown, the transceiver 20 provides an input to a control apparatus 24 which includes an indicator 27. A motion detector 21 on the vehicle provides an indication to the control apparatus 24 as to whether or not the vehicle is proceeding above some predetermined low velocity. Finally, a push button 25 or similar device provides the means for the operator to pre-acknowledge his approach to the potentially dangerous location. In the event that he fails to so pre-acknowledge, an alarm 22 is energized. On the other hand, if pre-acknowledgement takes place within some predetermined constraint, for example, 30 seconds, of the approach to the signalling means 18, then when the echo is received, a buzzer 23 is energized for a short period of time to signify to the operator that the apparatus is operating properly. Alarm energization energizes an indicator 27 (incandescent bulb or equivalent) which indication is cancelled when the alarm is cancelled. Optionally, a recorder 26 can be provided to be operated by the control apparatus 24, to provide a record of the events as they occur. One simple form for recorder 26 is a counter (electronic or mechanical) to count the number of times the alarm is energized. The control apparatus 24 is arranged to energize the alarm 22 if either an echo is received without a pre-acknowledgement or if the acknowledgement device 25 is continuously operated or if no echo is received within a specified constraint after pre-acknowledgement. The presence of the buzzer 23 and alarm 22 are not essential to the invention. A single audible warning device is sufficient, which is energized continuously if the proper sequence of events does not occur, and which can be energized only briefly if the sequence is properly followed. The control apparatus 24 can be implemented with a variety of devices, a microprocessor embodiment is disclosed with reference to FIGS. 3 and 4 and a discrete circuit arrangement is disclosed with reference to FIG. 5.

The transceiver 20 can cooperate with an inductive loop buried in the pavement. Coverage can be limited by installing the loop only on the approach side of the roadway. Alternatively, a beamed signal is directed across the roadway from the wayside where it may be generated or merely reflected. The vehicle's antenna is on the side of the vehicle directed toward the curb and thus is only active for approach movements. Still another technique is to transmit short pulses which are reflected by the wayside signalling means and to measure the transit time to discriminate approach motion. This is implemented by receiver gating, for example.

Figure 6A:
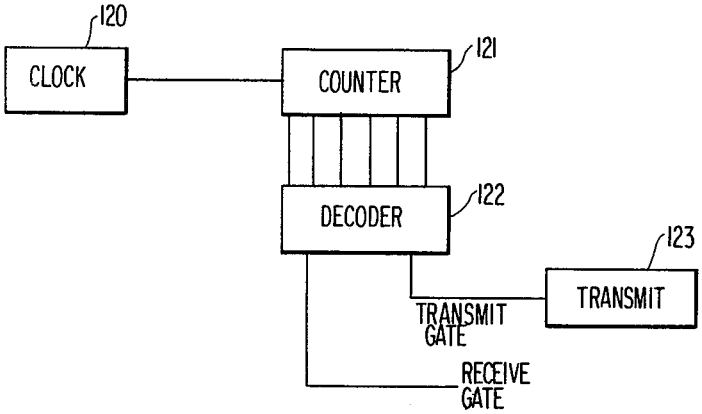
FIGS. 6A and 6B are respectively, a block diagram of the transmitter portion of the transceiver and a timing diagram of one example of circuit waveforms.
Figure 6B:
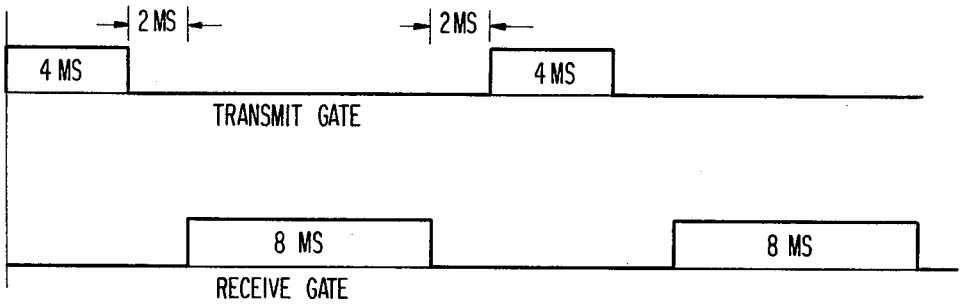

As shown in FIG. 6A, a clock 120 drives a counter 121 which operates a decoder 122 producing a 4 ms. transmit gate in a 16 ms. cycle and an 8 ms. receive gate, as shown in FIG. 6B.

As shown in FIG. 3, a microprocessor 30 is coupled to a memory device 31 which can be a read only memory. The microprocessor itself can be any one of a variety of well known devices, an RCA COS/MAC 1802 is suitable, which can be driven at an appropriate frequency, i.e., 2 MHz. The program can be contained in approximately 512 8 bit words. The microprocessor 30 is interfaced to a variety of vehicle carried apparatus.

The vehicle carried transceiver 20 provides a preferably optically coupled input through a LED 34 and a phototransistor 35 to one input $\overline{EF}_1$. As shown in FIG. 3, detection of the signalling means 18 is indicated by a pulse train of predetermined repetition frequency and pulse width.

A second input to the microprocessor is provided by the motion detector 21. As shown, the vehicle's velocity is represented by a pulse train whose repetition rate is related to the vehicle velocity. The pulse train itself may be directly input to the microprocessor at $\overline{EF}_2$, in which case the microprocessor determines, from the pulse repetition rate, the vehicle velocity. On the other hand, the pulse train can be provided to a timer 33 which will then output one of two dc levels, depending upon whether or not the velocity exceeds a predetermined low threshold. A third input to the microprocessor is provided by a push button 25, which can close the circuit between a source of positive potential and ground. Accordingly, with the push button 25 unoperated, a positive potential is provided to the input $\overline{EF}_3$, and if the push button 25 is actuated, a zero potential is applied. The vehicle power source, typically a battery, may provide power to the microprocessor through a voltage regulator 36 and a switch 37 to the $\overline{CLR}$ input. The switch 37 is controlled by one of the microprocessor outputs for an initialization procedure.

The microprocessor provides two outputs, $N_1$ and $N_2$, to a latch 38. The latch 38 drives an alarm drive and a buzzer drive and may also be connected to the optional recorder 26. The alarm drive is arranged to energize indicator 27 which may comprise an incandescent lamp or equivalent.

FIG. 4 is a flow chart for the program which is stored in the memory 31 and which controls operation of the entire system. As shown in FIG. 4, the program enters at function 40 and function 41 serves to disable the interrupts. An initialization procedure 42 is performed to reset the registers in the microprocessor and then function 43 enables the interrupts. Function 44 determines if a push button is actuated. If it is not, the routine loops at this point looking for a push button actuation. At this point, we will assume that the push button 25 is actuated prior to detection of the signalling means 18. Later we will see what happens if that is not the case.

Assuming the push button 25 is actuated, then function 50 determines if there is motion. If not, the program loops back. If motion is detected, then function 45 initializes a T1 timer, which is to time out a predetermined period, for example, 30 seconds. Function 47 then increments the T1 timer via the clock, and function 48 determines if the vehicle is in motion. If the vehicle is not in motion, the routine loops around functions 45, 47 and 48 waiting for detection of vehicle motion. If, in the block diagram of FIG. 3, the timing device 33 is provided, then the motion detection depends on the presence of the proper dc level at the associated input. On the other hand, if the microprocessor 30 accomplishes motion detection, it may do so on an interrupt driven basis or on a scan basic. In either event, a flag is set or not set, depending upon whether the vehicle's motion is above a predetermined low threshold. When motion is detected, function 49 determines if the timer T1 has timed out. If it has not, the routine loops back to function 47 at which point the timer is incremented. The routine maintains the loop between functions 47 and 49 until either the timer times out or the signalling means 18 is detected. If, in the interim, the vehicle stops, the loop is broken and when the vehicle restarts the timer T1 is again initialized. This is advantageous if, for example, the vehicle is in traffic, and actually stops moving. In that event, the 30 seconds could quickly expire and the vehicle would not have a chance to reach the signalling means 18. This provision then allows the vehicle 30 seconds of continuous motion in order to reach the signalling means 18.

Assuming that at some point in the T1 cycle, the signalling means 18 is detected, the transceiver interrupt stops the processing and the interrupt routine, beginning at function 55, is performed. The first function 56 is to disable interrupts. Function 57 examines the input which caused the interrupt to determine whether it has the proper pulse repetition frequency and pulse width, and a flag is set or not set depending upon whether or not the test is passed. Function 58 then determines whether or not the required input has been recognized, i.e., has the signalling means been detected. If it has, function 62 determines whether or not the timer T1 is timing out. Assuming it is, function 63 energizes the buzzer tone to inform the operator that the cycle has been successfully completed. Since the signalling means 18 may be detected for a substantial period of processor operation, functions 65 and 66 determine whether or not the signalling means 18 is still being detected. If it is, the program loops between functions 65 and 66 until the signalling means 18 is no longer detected. At that point, function 67 initializes a second timer T2. The timer T2 allows the vehicle to pass the grade crossing, for example, and travel beyond any signalling means 18 which is located on the other side of the grade crossing for traffic in the opposite direction. However, in the event that two potentially dangerous locations are relatively close together, the loop of functions 67, 68, 72 and 69 includes function 68 looking for a push button input. If the operator pre-acknowledges a further potentially dangerous location in this loop, then function 70 resets the registers, function 71 again enables the interrupts and the loop is re-entered at function 45 wherein the T1 timer is initialized. On the other hand, if no push button actuations are detected, then when the timer T2 expires, function 69 determines that the timer has expired, function 54 resets the registers and function 43 enables interrupts and the loop is again entered looking for a push button entry.

If, after entry of the interrupt routine, function 58 determines that a proper output is not present, i.e., the interrupt is caused by noise or some other spurious signal, function 58 then proceeds and directs the processor to function 59 to determine whether or not the timer T1 is running. If it is not, then the processor is returned to function 43 to again enable the interrupts and to look for push button actuation. On the other hand, if the timer T1 is running, then function 60 increments the timer by a fixed amount to compensate for the time lost in the interrupt routine, function 61 again enables the interrupts and function 47 again increments the timer and the program returns to wait for expiration of the timer.

If a proper interrupt is received, but function 62 determines that the timer T1 is not on, this means that the operator has failed to pre-acknowledge the approach to the potentially dangerous location. Accordingly, function 51 sounds the alarm. At this point in the routine, function 52 determines if the vehicle is in motion or proceeding at a velocity in excess of the low speed threshold of the speed sensor. So long as the vehicle is in motion, the processor loops between functions 51 and 52, maintaining the alarm energized. Thus, the operator cannot disable the alarm. When the vehicle motion ceases, as determined at function 52, then function 53 determines if the operator has actuated the push button. If he has not, the alarm is maintained energized until the operator energizes the push button at which point function 54 resets the registers and returns the processor to function 43 to again enable interrupts.

It should be noted that the alarm is energized either when the signalling means 18 is detected and the operator has not pre-acknowledged, or when the signalling means 18 is not detected within the period of the timer after a pre-acknowledgement. Regardless of the manner in which the alarm is energized, it is maintained energized until the vehicle is brought to substantially a full stop, at which time the operator can disable the alarm by actuating the push button.

The motion decision function 50 is effective to check operation of the motion detector. The typical failure mode of this device is to fail indicating no motion. In such event, the T1 timer cannot be set, resulting in alarm energization regardless of proper pre-acknowledgement. This serves to call attention to the failure.

Figure 5A:
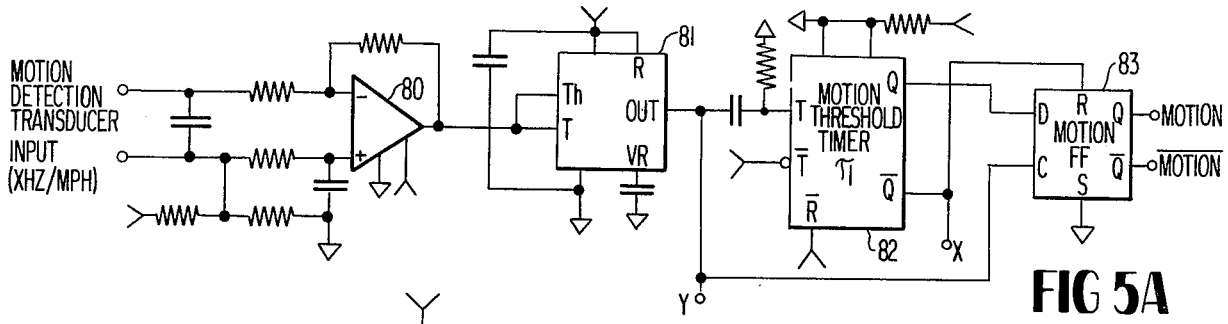
Figure 5B:
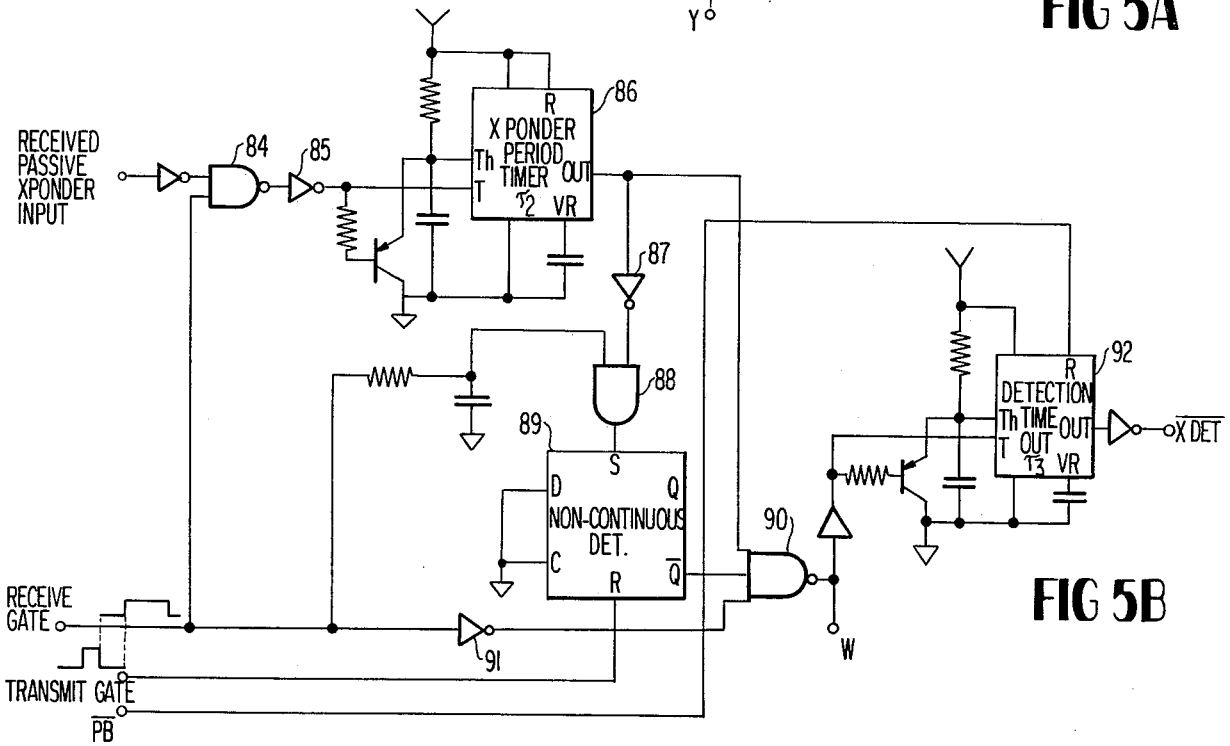
Figure 5C:
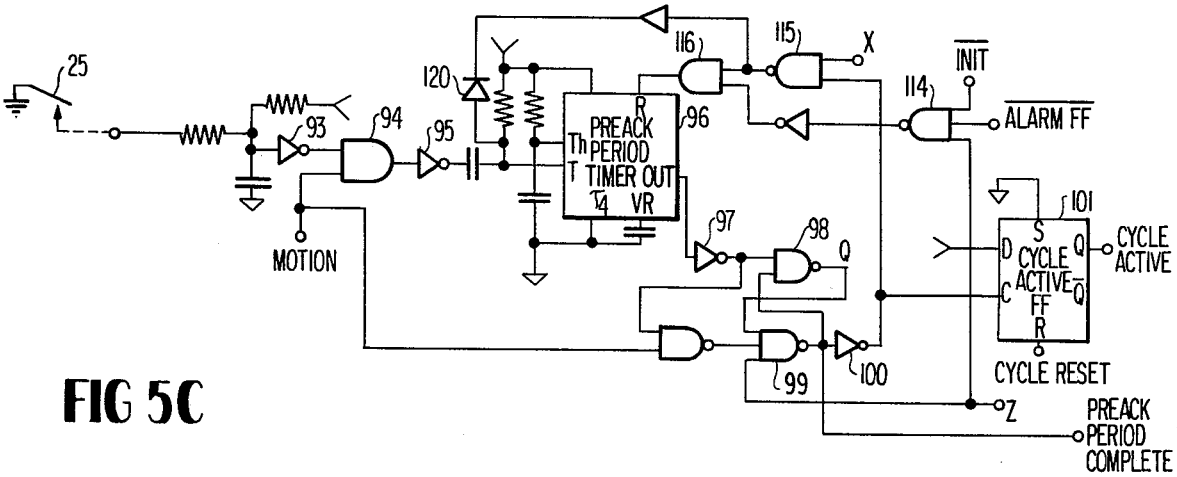

The discrete embodiment of the invention is shown in FIGS. 5A through 5D with FIG. 5E an alternate to FIG. 5C.

FIG. 5A illustrates a motion detector, which can also be the motion detector employed to provide an input to the microprocessor embodiment of FIGS. 3 and 4. As mentioned above, the microprocessor can, in the alternative, provide the motion detection function. The motion detector shown in FIG. 5A receives a square wave signal with frequency related to vehicle velocity from a velocity transponder (not illustrated). An operational amplifier 80 is provided to amplify the input signal. The output of the operational amplifier 80 is provided to a 555 timing circuit 81 operating as a threshold device whose output toggles when the excursion at the input exceeds the threshold level. A re-triggerable one shot 82 acts as the motion threshold timer with a time constant $\tau 1$ which is set slightly longer than the period of the motion transducer at approximately 2 mph. The Q output of the timer 82 is coupled to the D input of a flip-flop 83 whose Q output is the signal MOTION and the $\overline{Q}$ output is a signal $\overline{\text{MOTION}}$. The flip-flop is clocked at the rising edge of the output of the threshold device 81. If the period of the transducer output is less than $\tau 1$, then the flip-flop is set, i.e., motion is detected, and remains set so long as speed above the threshold is maintained.

FIG. 5B illustrates the receiving portion of the transceiver which serves to monitor the received or reflected signal, and if the received signal is in the proper form, produces an output $\overline{\text{X DET}}$, which goes low on detection. As shown in FIG. 5B, the received transponder input is negated and applied as one input to a NAND gate 84 which is also gated by the receive gate (see FIG. 6B). The output of the NAND gate 84 is provided to an inverter 85 and thence is provided to a re-triggerable monostable timer 86. The period $\tau_2$ of the timer 86 is to be slightly longer than the period of the proper transponder signal so that, if the input goes low before the time $\tau_2$ expires, the output remains high. The output of the timer 86 is provided to an inverter 87 which provides an input to an AND gate 88 the other input of which is the receive gate. The output of AND gate 88 is provided to set a flip-flop 89 which is reset by the transmit gate. The $\overline{Q}$ output of flip-flop 89 is provided as one input to a NAND gate 90, another input is provided, through an inverter 91, by the receive gate. Finally, the third input to the NAND gate 90 is the output of the timer 86. When the timer output remains high, indicating a proper transponder input, during the period of the receive gate, the flip-flop 89 remains reset providing a high $\overline{Q}$ output. If the signal is discontinuous, or if it does not occur during the presence of the receive gate, then the flip-flop 89 becomes set. Assuming the flip-flop 89 remains reset, at the conclusion of the receive gate, NAND gate 90 has three high inputs producing a low output to set the re-triggerable timer 92. The timer 92 has a period $\tau 3$ of about 2 seconds to negate bounce and fringing effects as the vehicle leaves the transponder field. The output of the timer 92 is X DET, which is negated to produce $\overline{\text{X DET}}$. Either can be used as a signal indicating presence of the transponder input. It should be noted that the transponder shown in FIG. 6A and 5B can also be used as an input to the microprocessor in which case the interrupt routine of FIG. 4 can be simplified in that the de-bouncing functions are accomplished by the circuitry rather than by the microprocessor. In any event, the signal X DET or $\overline{\text{X DET}}$ is used in the remaining portions of the control 24.

FIG. 5C shows the portion of the logic responsive to actuation of the push button 25. In the apparatus shown in FIG. 5C, the pre-acknowledgement period, begun by actuation of the push button is based upon time elapsed; in an alternative embodiment, shown in FIG. 5E, the pre-acknowledgement period of constraint is based upon distance travelled.

As shown in FIG. 5C, the push button input, inverted by inverter 93, is provided as an input to an AND gate 94, the other input of which is provided by the signal MOTION. Thus, the output of AND gate 94 goes high only when the push button is actuated in the presence of motion. This logic, similar to the functions 44 and 50 in the flow diagram of FIG. 4, acts to check the proper operation of the motion detector. The output of AND gate 94 is coupled, through an inverter 95, to a timer 96 having a time period $\tau_4$ (for example, 10–30 seconds). Actuation of the push button in the presence of motion produces a signal at the output of timer 96 which is coupled through an inverter 97 to set a flip-flop comprising cross-coupled NAND gates 98 and 99. Once the timer 96 is set, if motion ceases it will be set again to time out a new period which starts when motion is again detected. The flip-flop comprising cross-coupled NAND gates 98 and 99 remain set, however, until the timer period $\tau_4$ expires in the presence of motion.

The $\overline{Q}$ output of the flip-flop comprising the cross-coupled NAND gates 98 and 99 is coupled, through an inverter 100, to clock the cycle active flip-flop 101 to its set condition. Thus, the cycle active flip-flop 101 is set at the beginning of the pre-acknowledgement constraint (in response to operation of the pushbutton 25) and remains set until cycle reset is produced. Cycle reset is produced as will be explained in connection with FIG. 5D during X DET, initialization (INIT) or when the alarm flip-flop is set. The timer 96 can be reset under a variety of conditions. If the cycle is successfully completed, i.e., the buzzer timer is operated then timer 96 is reset by AND gate 116 as it receives a high input from NAND gate 115 (X is low in the presence of motion) and a high input from the inverted output of NAND gate 114 since the z signal goes high. Likewise, during initialization, in the presence of motion timer 96 is reset, or when the alarm FF is set. Similarly, if motion ceases (X goes high), the output of NAND 115 gate goes low and current drained through diode 120 resets the timer 96.

FIG. 5D illustrates the remaining portions of the control logic 24. As shown in FIG. 5D, the cycle active signal is coupled to a buzzer timer 102 triggering the timer when the cycle active flip-flop is reset. This produces a short (for example, 300 msec.) pulse which produces a short tone on the buzzer/alarm drive, at the successful completion of a cycle. The end cycle flip-flop 103 is also set when cycle active is set. The $\overline{\text{X DET}}$ clocking signal is coupled to flip-flop 103 via AND gate 103A and is arranged to maintain this flip-flop set at the completion of a successful cycle when the transponder may still be detected. If a cycle is completed without a transponder input then, as will be explained, the alarm flip-flop 105 is set. The ALARM FF signal to gate 103A resets flip-flop 103 when the alarm flip-flop 105 is reset. If any event, the CYCLE ACTIVE signal is provided as an input to a NAND gate 104 whose other input is the signal PREACKNOWLEDGEMENT PERIOD COMPLETE. This signal is produced as shown in FIG. 5C, at the output of NAND gate 99, when the pre-acknowledgement timer has timed out, in the presence of motion. An alarm flip-flop 105 consists of a pair of cross-coupled NAND gates 106 and 107. NAND gate 106 has one input from the output of NAND gate 104, another input from the output of NAND gate 108, and a third input from the output of NAND gate 107. NAND gate 108 has as one input the $\overline{Q}$ output of flip-flop 103, and the other input is the signal W, negated by the inverter 109. This signal is only produced in the presence of a transponder detection (FIG. 5B). NAND gate 110 has as one input the signal $\overline{\text{MOTION}}$, and as another input, the signal $\overline{\text{PB}}$ inverted by an inverter 111. Thus, flip-flop 105 can be set under a number of circumstances. If the cycle active flip-flop is set, indicating that the pre-acknowledgement period has begun, when thereafter the pre-acknowledgement period is completed and cycle active remains set, the output of NAND gate 104 is capable of setting alarm flip-flop 105. On the other hand, if the cycle active flip-flop has not been set, i.e., a high $\overline{Q}$ output of flip-flop 103, then the alarm flip-flop 105 can be set by detecting the transponder. Setting the alarm flip-flop 105 produces a low output of the NAND gate 107, and a high output of NAND gate 106. The high output of NAND gate 106 is fed back to the buzzer timer. The low output of NAND gate 107, coupled through NAND gate 112, energizes the buzzer/alarm driver and also serves to produce the cycle reset signal. The buzzer/alarm driver, when flip-flop 105 becomes set, remains energized until motion ceases and the push button is actuated. Under those conditions, the output of NAND gate 110 provides a resetting signal to the flip-flop 105 to terminate the buzzer/alarm drive.

The preceding apparatus operates on a pre-acknowledgement period which is a function of time. The pre-acknowledgement period is timed out during continuous motion of the vehicle. If the vehicle stops, the timer is re-energized to begin timing at a new period. It may also be desirable, under some circumstances, to have a pre-acknowledgement constraint which is not a function of time, but which is a function of distance travelled. This would require the operator to energize the push button within a predetermined distance of the signalling means 18. Such apparatus is disclosed in FIG. 5E, which will perform that function when substituted for the apparatus shown in FIG. 5C.

As shown in FIG. 5E, the cycle active flip-flop 101 has on its D input the signal MOTION and is clocked by the push button. The flip-flop can be reset by the signal CYCLE RESET. Thus, when motion is detected in the presence of a push button actuation, the cycle active flip-flop 101 becomes set, producing the high Q output. The low going $\overline{Q}$ output resets a binary counter which is clocked by the motion detector 113, which therefore begins counting. Depending upon which one of a selected number of output taps are coupled to the terminal PREACKNOWLEDGEMENT PERIOD COMPLETE, the vehicle must travel at pre-determined distance before producing that signal. That signal, as has been mentioned above, will serve to set the alarm flip-flop 105 if the signalling means 18 is not detected prior to its production. The distance travelled which corresponds to the pre-acknowledgement period is thus variable by selecting one of the output taps.

In addition, the debouncing function can be easily implemented in this embodiment by deleting the timer 92 and using instead the potential W to reset counter 113 (FIG. 5E). Thus, the END OF CYCLE flip-flop 103 is reset only after the counter has reached a selected count. With this variation, the effect of all transponder inputs (after the first) are ignored until the vehicle has travelled some selected distance.

While we have disclosed herein constraints based on time or distance only with respect to the discrete circuit embodiment of the invention, it will be apparent that it is within the skill in the art to change the logic of the microprocessor to provide a distance based constraint rather than the time based constraint which is specifically disclosed.

From the foregoing, it will be apparent that the discrete circuit of FIGS. 5A–E, in many respects, a counterpart to the logic provided by the flow chart of FIG. 4.

What is claimed is:

1. A driver alert system for a vehicle moving under control of an operator to insure operator attentiveness at a wayside location which is potentially dangerous comprising:

signalling means mounted on said wayside in advance of said location in the direction of vehicle travel, first means located on said vehicle responsive to said signalling means for producing a distinctive signal in response to detection of said signalling means, sensible warning means on said vehicle providing a signal sensed by a vehicle operator, operator-actuated means on said vehicle, and control means, responsive to said first means and to said operator-actuated means, for enabling said sensible warning means in response to said first means detection of said signalling means in the absence of prior operation of said operator-actuated means, and for maintaining said sensible warning means operated as long as said operator-actuated means is not actuated.

2. The apparatus of claim 1 which further includes:

vehicle speed sensing means on said vehicle for sensing whether or not said vehicle is proceeding above a predetermined velocity and in which said control means responds to said vehicle speed sensing means and to said operator-actuated means to disable said sensible warning means only on operation of said operator-actuated means when said speed sensing means indicates that said vehicle is proceeding at a velocity less than said predetermined velocity.

3. The apparatus of claim 2 wherein said control means includes timing means and in which said control means responds to operation of said operator-actuated means within a predetermined time prior to operation of said first means to prevent enablement of said sensible warning means.

4. The apparatus of claim 2 wherein said vehicle speed sensing means provides a signal related to vehicle velocity and said control means includes means integrating said signal related to vehicle velocity to provide a measure of vehicle travel and said control means responds to operation of said operator-actuated means within a predetermined distance of vehicle travel prior to operation of said first means to prevent enablement of said sensible warning means.

5. The apparatus of claim 3 in which said control means responds to operation of said operator-actuated means within a predetermined time prior to operation of said first means to prevent energization of said sensible warning means in a first mode in which said sensible warning means can only be de-energized when said vehicle is reduced in velocity below a predetermined velocity, and in which said sensible warning means is energized in a second mode for a predetermined period following operation of said first means within a predetermined time after operation of said operator-actuated means.

6. The apparatus of claim 5 in which said sensible warning means includes an alarm operated in said first mode, providing an annoying sensible signal when energized and a second sensible signal producing device operated in said second mode providing an audible signal for a brief predetermined period.

7. The apparatus of claim 2 in which said control means includes a stored program computer with memory means, said memory means, and a logic means in said computer, including:

first logic circuit means for detecting operation of said operator-actuated means, second logic circuit means for detecting motion of said vehicle above a predetermined velocity, and third logic circuit means responsive to operation of said first means.

8. The apparatus of claim 7 in which said logic means also includes timing means for timing a predetermined time in response to an actuating signal, said logic means providing said actuating signal to said timing means in response to said first logic circuit means, energizes said sensible warning means on expiration of said predetermined time in absence of operation of said third logic circuit means, and resets said timing means in response to operation of said third logic circuit means within said predetermined time.

9. The apparatus of claim 8 in which said logic means inhibits operation of said timing means, if previously initiated in response to said second logic circuit means detecting vehicle velocity below said predetermined velocity for so long as said velocity remains below said predetermined velocity.

10. The apparatus of claim 8 in which said control means energizes said sensible warning means in a first mode in response to operation of said first means without operation of said operator-actuated means within a prior predetermined time or operation of said operator-actuated means without succeeding operation of said first means within a predetermined time thereafter, in which first mode said sensible warning means remains energized until vehicle velocity is reduced below said predetermined velocity.

11. The apparatus of claim 8 in which said control means energizes said sensible warning means in a second mode responsive to operation of said operator-actuated means followed within said predetermined time by operation of said first means, in which second mode said sensible warning means is energized only for a predetermined period.

12. The apparatus of claim 11 in which said sensible warning means includes an alarm operated in said first mode, and a second audible signalling device operated in said second mode.

13. The apparatus of claim 2 in which said control means includes a timer for timing a predetermined time, means for initiating said timer responsive to actuation of said operator-actuated means, logic means responsive to said first means and to said timer for energizing said sensible warning means in response to operation of said first means if said timer is not timing said predetermined time, and responsive to expiration of said predetermined time without operation of said first means for energizing said sensible warning means.

14. The apparatus of claim 13 in which said sensible warning means includes an alarm and a buzzer, said control means including logic means to energize said buzzer for a predetermined period in response to operation of said first means while said timer is timing said predetermined period.

15. A warning system for maintaining the alertness of a vehicle operator when approaching a potentially dangerous location comprising:

signalling means mounted in advance of a potentially dangerous location in the direction of travel of a vehicle, for manifesting the presence of the vehicle within a defined zone, first means on said vehicle energized in response to detection of said signalling means when said vehicle enters said zone, vehicle speed sensing means generating a signal indicative of whether or not said vehicle is exceeding a predetermined low velocity, operator-actuated means for manifesting operator alertness when manually and momentarily operated, alarm means to produce an annoying alarm when energized, and control means responsive to said first means, said vehicle speed sensing means and said operator-actuated means to energize said alarm whenever said first means is energized in the presence of speed in excess of said predetermined velocity unless said operator-actuated means is operated within a predetermined constraint of energization of said first means.

16. The system of claim 15 in which said control means includes timing means initiated to time out a predetermined period corresponding to said constraint on operation of said operator-actuated means.

17. The system of claim 16 which includes means to reinitiate said timing means in response to vehicle speed below said predetermined low velocity.

18. The apparatus of claim 15 in which said vehicle speed sensing means produces a signal related to vehicle velocity and in which said control means includes means to integrate said signal related to vehicle velocity and in which said predetermined constraint corresponds to a predetermined distance.

19. The apparatus of claim 15 which further includes second means for producing a sensible signal of brief duration and in which said control means energizes said second means on operation of said first means within said predetermined constraint following operation of said operator-actuated means.

20. The system of claim 15 in which control means maintains said alarm means energized until said operator-actuated means is operated in conjunction with vehicle velocity below said predetermined velocity.

21. The apparatus of claim 15 in which said control means includes a microprocessor.

22. The apparatus of claim 15 in which said control means includes a discrete logic circuit.

23. The apparatus of claim 15 which further includes recording means responsive to operation of said alarm means.

* * * * *